US005702525A

United States Patent [19]

Liou

[11] Patent Number: 5,702,525

[45] Date of Patent: Dec. 30, 1997

[54] PAINT ROLLER DEVICE

[76] Inventor: Sam Foo Liou, 4 F, 57, Wuhwa Street, Chungli, Taoyuan Hsien, Taiwan

[21] Appl. No.: 695,894

[22] Filed: Aug. 12, 1996

[51] Int. Cl.[6] ..... B05C 1/00

[52] U.S. Cl. ..... 118/200; 118/203; 118/244; 118/256; 118/261; 118/264; 15/230.11; 401/218

[58] Field of Search ..... 118/200, 203, 118/244, 256, 261, 264; 401/218; 15/230.11

[56] References Cited

U.S. PATENT DOCUMENTS

| | | | |
|---|---|---|---|
| 2,548,580 | 4/1951 | Bick | 401/218 |
| 2,820,978 | 1/1958 | Brady | 401/218 |
| 2,824,325 | 2/1958 | Lussier | 401/218 |
| 4,630,952 | 12/1986 | Elbaum | 401/218 |

FOREIGN PATENT DOCUMENTS

| | | | |
|---|---|---|---|
| 437603 | 7/1948 | Italy | 401/218 |

*Primary Examiner*—Laura Edwards
*Attorney, Agent, or Firm*—Pro-Techtor International

[57] ABSTRACT

An improved paint roller device includes a semi-enclosed trough for holding paint, a paint roller disposed in the trough, a uniform roller above the paint roller and in contact therewith, a roller next to the uniform roller and in contact therewith, and a substantially U-shaped frame joining these rollers to the trough. The paint is transferred by the paint roller in the trough to the uniform roller before it is transferred to the roller. The paint is uniformly distributed so that an evenly painted surface may be achieved. Paint dripping and scraping may be eliminated.

5 Claims, 3 Drawing Sheets

PAINT ROLLER DEVICE

BACKGROUND OF THE INVENTION (a) Field of the Invention

The present invention relates generally to a paint roller device, and more particularly to a high-efficiency paint roller device in which the roller may supply uniformly distributed paint.

(b) Description of the Prior Art

Painting is an economical way to decorate the rooms or walls. The painting effects may not be satisfactory due to poor painting skill or painting tools. Pressure brushes used in conjunction with compressed air have been developed. But the painting effect is not very satisfactory either. Moreover, they are inconvenient to use since they require electrical wires, power sources, pumps or air compressors, which are space-occupying. Furthermore, it is not easy to control the paint output so that the painting efficiency and quality can hardly be improved.

SUMMARY OF THE INVENTION

Accordingly, a primary object of the present invention is to provide an improved paint roller device which is convenient to operate and has the advantages that there is no dripping of paint, no need to scrape excess paint on the walls, and the paint is uniformly distributed on the roller.

In order to achieve the above-mentioned object, the improved paint roller device of the present invention essentially comprises a trough body containing paint, a paint roller pivotally disposed in the trough body, a uniform roller with criss-cross stripes above the paint roller and in contact therewith, a roller next to the uniform roller for painting purposes, and a substantially U-shaped frame joining all of the rollers to the trough body. The paint first sticks to the paint roller which is provided with horizontal stripes that can distribute the paint evenly. The paint is then transferred to the uniform roller where it is more uniformly distributed before it is passed to the roller for painting purposes.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
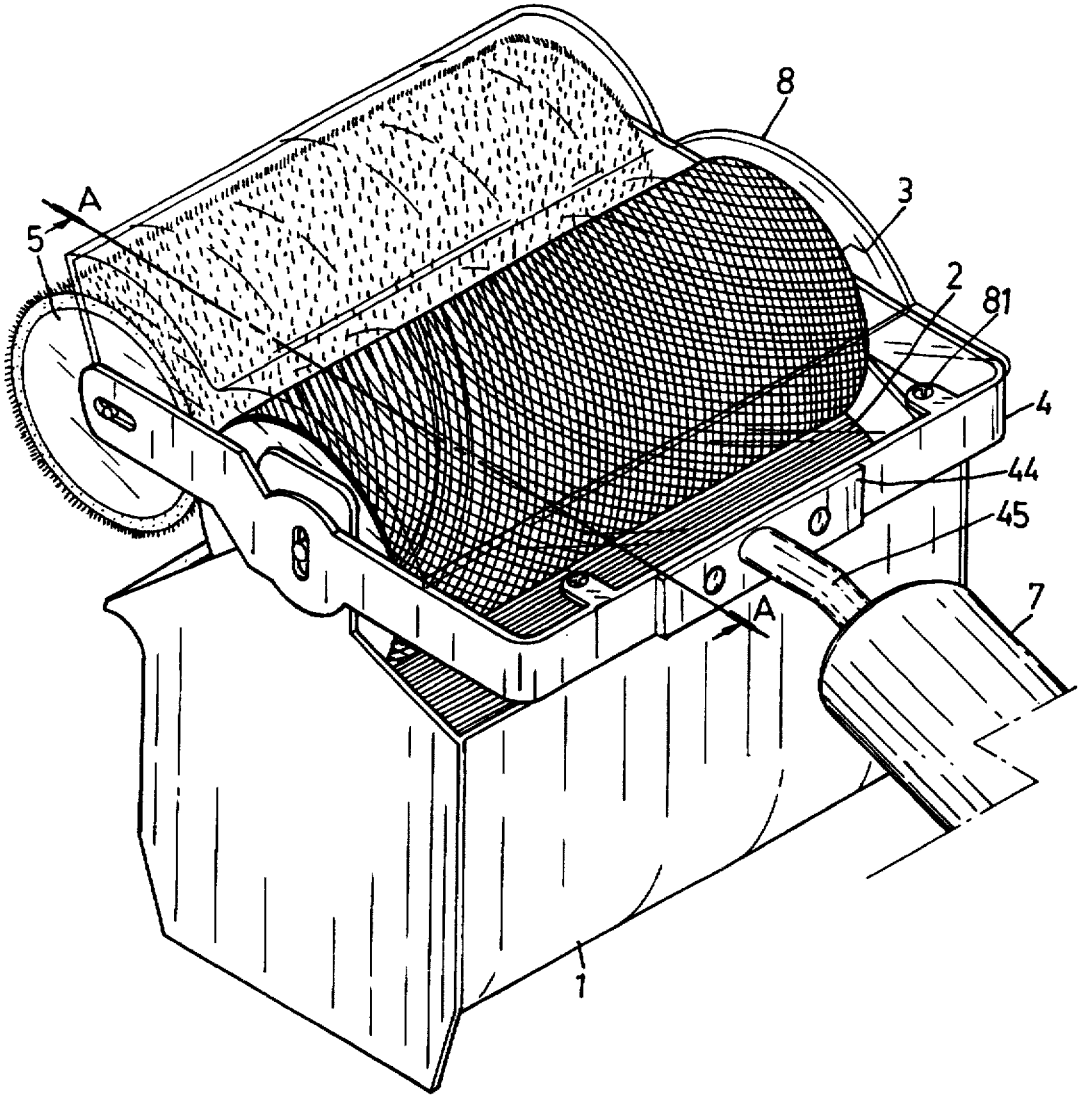
FIG. 1 is an elevational view of the paint roller device of the present invention.
Figure 2:
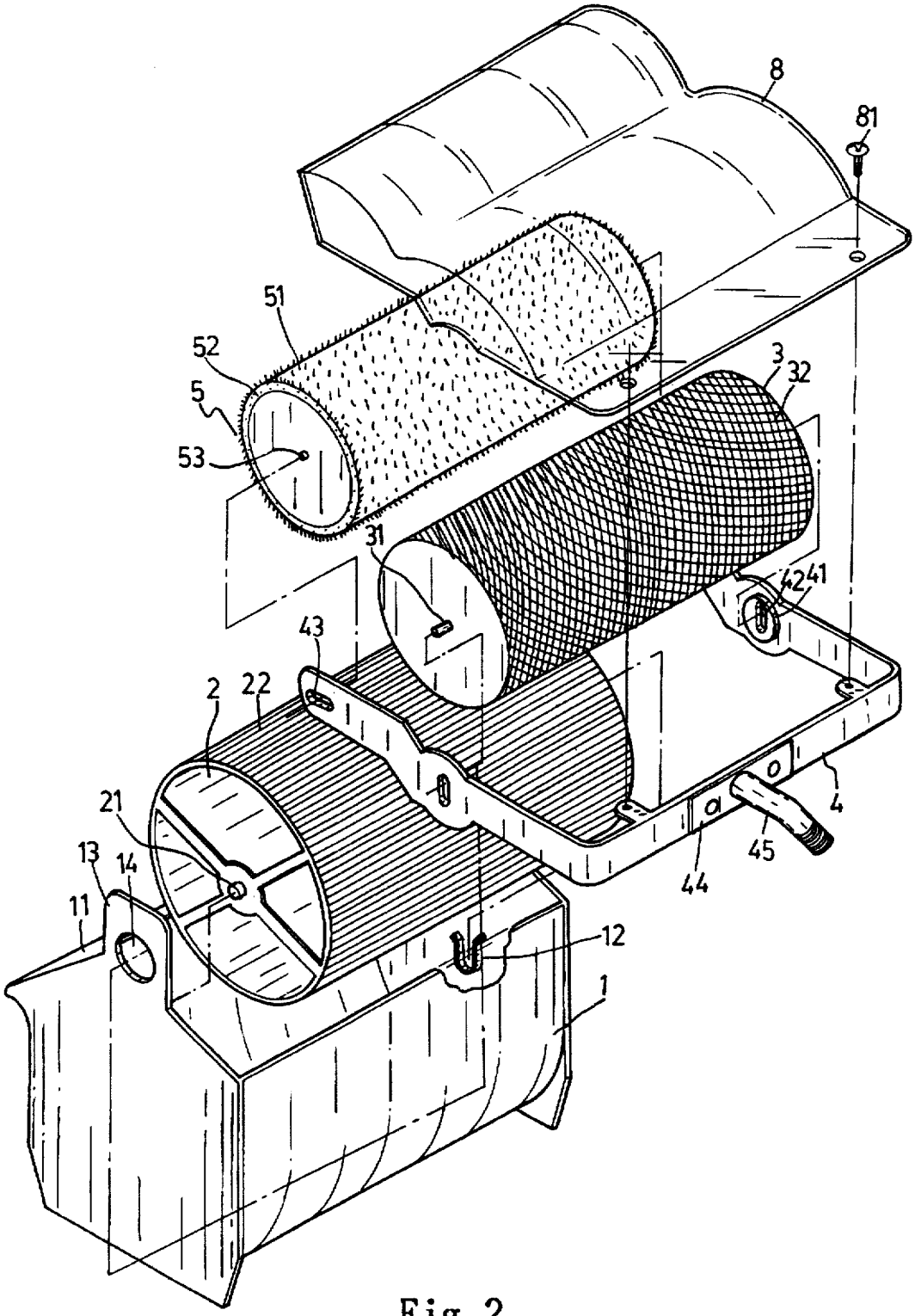
FIG. 2 is an exploded elevational view of the paint roller device of the present invention.
Figure 3:
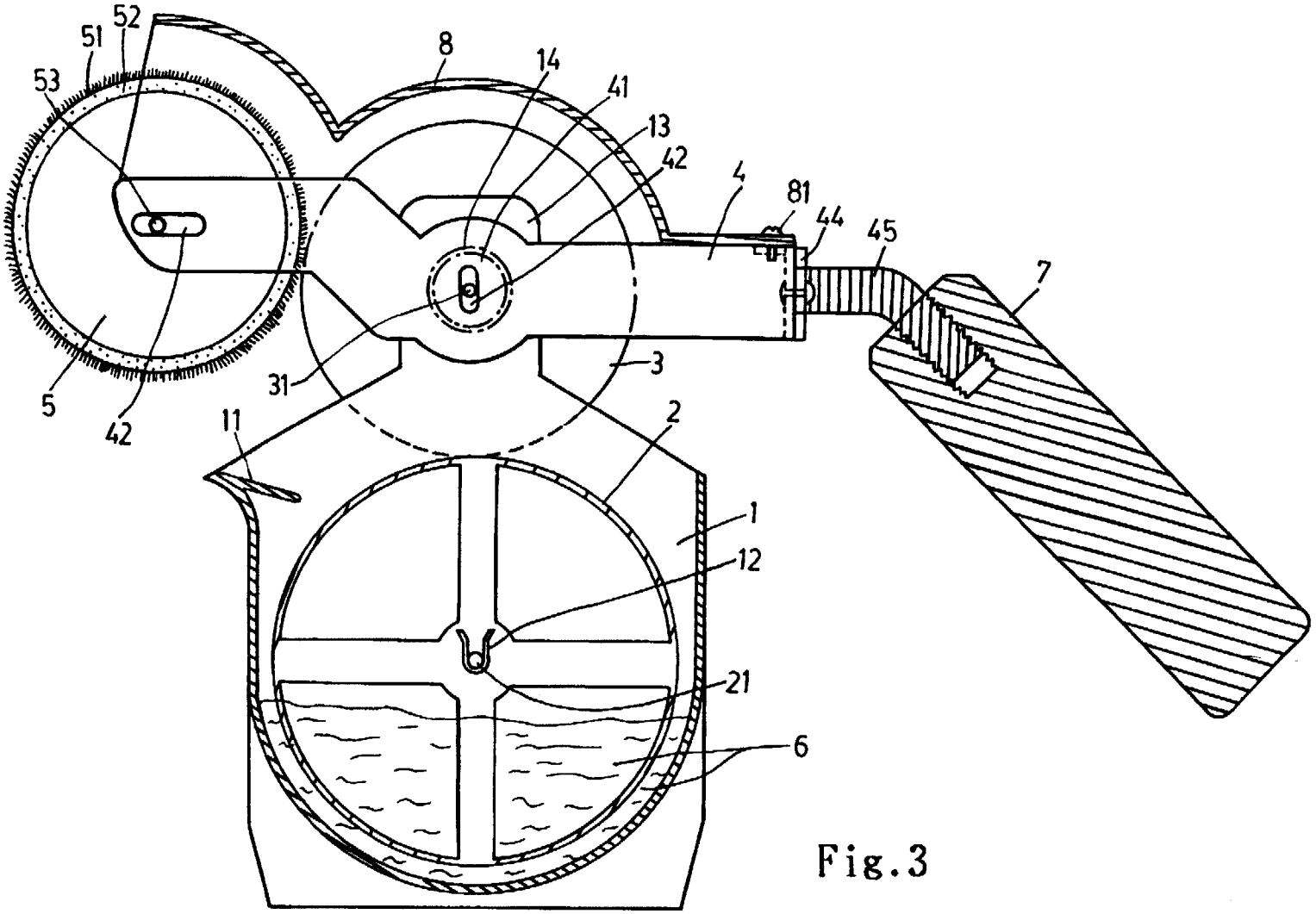
FIG. 3 is a sectional view of the paint roller device of the present invention.

With reference to FIGS. 1, 2 and 3, the present invention essentially comprises a trough body 1, a paint roller 2, a uniform roller 3, a substantially U-shaped frame 4 and a roller 5 having an inner foam layer 52 and a fibrous filaments 51 on its surface. The trough body 1 has a semi-enclosed interior for holding paint. A front rim of the trough body 1 is provided with an inwardly extending baffle plate 11 for preventing paint in the trough body 1 from spilling when the trough body 1 incidentally swings back and forth during painting operations. A bearing seat 12 is disposed at either side within the trough body 1 for receiving and positioning a hollow rotary paint roller 2 with a pivot pin 21 at either end thereof. Two symmetrical lugs 13 are respectively provided at an upper portion of the trough body 1 at the front and rear rims thereof. Each lug 13 has a pivot hole 14.

The U-shaped frame 4 has two side arms each of which having a central portion extending inwardly to form a projecting pivot 41. The side arms may be extended outwardly so that the projecting pivots 41 thereof fit into the pivot holes 14 of the lugs 13 at both ends of the trough body 1 from the outside such that the frame 4 is pivotally connected to the trough body 1. Each projecting pivot 41 is further provided with a longitudinal trough hole 42. When the frame 4 is connected to the trough body 1, two axles 31 at each end of the uniform roller 3 may be simultaneously fit into the through holes 42 of the frame 4, and the roller 5 may have its axles 53 at both ends respectively fit into a transverse slot 43 at a front end of each side arm of the frame 4. Thus, the uniform roller 3, the roller 5, the frame 4 and the trough body 1 may be pivotally connected such that the uniform roller 3 may be in contact with the paint roller 2 and the roller 5 may be in contact with the uniform roller 3 to drive one another.

The purpose of providing the foam layer 51 on the inside of the roller 5 is to enable the roller 5 to match various wall surfaces. The longitudinal through hole 42 of each projecting pivot 41 of the frame 4 is provided to enable the axles 31 of the uniform roller 3 to displace upwardly and downwardly along the through holes 42, preventing any mud or sandy particles from getting in between the uniform roller 3 and the paint roller 2 during operation, preventing them from rotating. The transverse slot 43 are provided to enable the roller 5 to adjust its position during operation so as to maintain a suitable interaction and contact with the uniform roller 3.

The side arms of the above-described U-shaped frame 4 have suitable resilience so that they may be pushed outwardly to a suitable extent. The paint roller 2, the uniform roller 3, the frame 4 and the roller 5 may be conveniently removed from the trough body 1 for cleaning purposes.

With reference to FIG. 3, when the user holds the roller 5 against the wall surface to be painted and rolls the roller 5, the roller 5 which is in a contact relationship with the uniform roller 3 and the paint roller 2 may drive the uniform roller 3 and the paint roller 2 so that the paint roller 2 partly dips into the paint 6 in the trough body 1. As the paint roller 2 is provided with a series of horizontal stripes 22 on its outer surface, the paint 6 is evenly distributed through its outer surface before it is transferred to the uniform roller 3. The outer surface of the uniform roller 3 is provided with a plurality of criss-cross stripes 32 which may further distribute the paint 6 evenly on the outer surface of the uniform roller 3 before the paint 6 is transferred to the roller 5 for painting purposes. Thus, the roller 5 may be supplied with evenly distributed paint 6 to achieve an evenly painted surface. Furthermore, as the design of the frame 4 matches the principle of gravity pull, even if the user operates the roller 5 in whatever direction, the trough body 1 containing the paint 6 may be maintained at a level position so that the paint 6 will not be spilt. The frame 4 is further provided with a reinforcing piece 44 at the middle of the rear end thereof. The reinforcing piece 44 is connected to a curved screw rod 45 which enables mounting of a short handle 7 or a long handle. In addition, a transparent cover 8 may be disposed above the uniform roller 3 and the roller 5 and may be locked to the frame 4 by means of a screw 81.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved paint roller device, comprising:

a hollow paint roller having a pivot pin at each end;

a trough body for holding paint material, said trough body having a front rim provided with an inwardly extending baffle plate, a bearing seat at each lateral side for receiving and positioning said paint roller such that said paint roller may freely rotate, and a pair of symmetrical lugs at an upper portion thereof at both ends, said lugs each having a pivot hole;

a uniform roller having pivot pins at each end;

an outer roller having an inner resilient foam layer and a surface layer with fibrous filaments, said outer roller having a pivot pin at each end; and a substantially U-shaped frame with two side arms, each of said side arms having a projecting pivot extending inwardly with respect to the other side arm, said side arms being extendible so that said projecting pivots may fit into said pivot holes of said lugs of said trough body to join said frame to said trough body, said projecting pivots each having a longitudinal through hole for receiving said pivot pins of said uniform roller, said side arms each further having a transverse slot at a front end thereof for receiving said pivot pins of said outer roller, whereby said uniform roller and said outer roller are connected with said frame and said trough body such that said uniform roller and said paint roller in said trough body and said outer roller are in contact and drive one another such that said outer roller causes said uniform roller and said paint roller to roll therewith so that said paint roller transfers said paint material to said uniform roller, said uniform roller then transfers said paint material to said outer roller for painting purposes.

2. The improved paint roller device as claimed in claim 1, wherein said longitudinal through holes of said projecting pivots at said side arms of said frame allow said uniform roller to displace upwardly and downwardly therein to prevent particulate contaminants from being lodged between said uniform roller and said paint roller, and said transverse slots at the front ends of said side arms allow a transverse position of said outer roller to be adjusted during operation and thereby maintain constant contact with said outer roller and said uniform roller.

3. The improved paint roller device as claimed in claim 1 wherein said paint roller has an outer surface provided with a plurality of horizontal stripes so that said paint material is distributed evenly on said outer surface before the paint material is transferred to said uniform roller, and said uniform roller is provided with a plurality of crisscross stripes to distribute the paint material evenly before transferring the paint material to the outer roller so that said outer roller applies a uniformly distributed layer of paint material to a surface.

4. The improved paint roller device as claimed in claim 1, wherein said frame is sufficiently resilient such that said side arms may be pushed outward to facilitate removal of said paint roller, said uniform roller and said outer roller from said trough body.

5. The improved paint roller device as claimed in claim 1, wherein a transparent cover is affixed to said U-shaped frame and is disposed above said uniform roller and said outer roller.

* * * * *